United States Patent [19]

Wilson

[11] 4,136,792

[45] Jan. 30, 1979

[54] QUICK ATTACHMENT DEVICE FOR A LIFTING TRACTOR

[75] Inventor: Charles D. Wilson, Burlington, Iowa

[73] Assignee: J. I. Case Company, Racine, Wis.

[21] Appl. No.: 849,082

[22] Filed: Nov. 7, 1977

[51] Int. Cl.[2] ..... E02F 3/70

[52] U.S. Cl. ..... 214/145 A; 37/117.5; 172/272; 214/620; 248/221.3; 292/302; 403/33; 403/353

[58] Field of Search ..... 214/145 A, 131 A, 620; 172/272, 778, 801; 37/117.5; 248/201, 223.3; 292/31, 175, 302, 334; 403/33

[56] References Cited

U.S. PATENT DOCUMENTS

| | | | |
|---|---|---|---|
| 3,319,060 | 5/1967 | Bartley | 248/223.3 X |
| 3,337,172 | 8/1967 | Jackson | 248/223.3 X |
| 3,876,091 | 4/1975 | MacDonald | 214/145 |

FOREIGN PATENT DOCUMENTS

| | | | |
|---|---|---|---|
| 2307752 | 11/1976 | France | 214/145 A |

*Primary Examiner*—Francis S. Husar
*Assistant Examiner*—George F. Abraham
*Attorney, Agent, or Firm*—Arthur J. Hansmann

[57] ABSTRACT

A quick attachment device for a tractor which has lift arms for supporting an implement, such as a loader bucket, lift fork, or the like. The rear side of the implement has two spaced-apart attaching portions in the form of hooks faced toward each other, and an attachment plate is held by the tractor lift arms and the lower edge is first positioned into the lower implement hook and then the plate is slid upwardly until the upper edge is engaged in the implement upper hook. A spring-loaded pin then automatically falls into a hole in the implement to secure the plate relative to the implement and thus attach the implement and plate together. A release cam is attached to the pin for withdrawing the pin and the attachment plate can then be manuevered out of the implement hooks to be removed from the implement when release is desired.

11 Claims, 3 Drawing Figures

QUICK ATTACHMENT DEVICE FOR A LIFTING TRACTOR

This invention relates to a quick attachment device for a lifting tractor, and, more particularly, it relates to a device for quickly attaching a tractor implement such as a loader bucket or a lift fork or the like to the tractor lift arms.

BACKGROUND OF THE INVENTION

The prior art is already aware of various arrangements for quickly attaching implements or the like to tractors. These devices exist in various complex forms and some of them require that the attaching pieces be accurately and carefully aligned and then the operator must maneuver a fastening or securing member in order to complete the attachment. Examples of the prior art are found in U.S. Pat. Nos. 3,237,795 and 3,672,521 and 3,794,195 and 3,874,534 and 3,876,091 and 3,887,096 and 4,030,624. These patents all generally show devices for attaching a lift bucket to the tractor lift arms, and for permitting release of the bucket when desired. However, the prior art devices are relatively complex in the requirement and arrangement for parts which are needed for the inter-engagement between the implement or bucket and the tractor lift arms; and very careful and accurate alignment of the attaching elements is required; and the attachment device is arranged so that the bucket extends a distance away from the lift arms and therefore creates an excessive load on the lift arms in the nature of an overbalanced condition; and some of those devices even require that the operator leave his tractor seat in order to maneuver parts included in the attachment device to complete the attaching.

Accordingly, it is a general object of the present invention to improve upon the prior art quick attachment devices and specifically to do so with a device which is simple but sturdy in construction and therefore is reliable in its operation and in its strength in supporting a lifting implement, such as a loader bucket or lift fork or the like.

More specifically, the present invention provides a quick attachment device of the aforesaid nature and which permits ready and easy attachment and detachment of an implement, without requiring that the operator leave his tractor seat for achieving the attaching, and the parts are placed in firm and snug contact without reliance upon spring-loaded elements for making a firm contact but only utilizing a spring-loaded pin for retaining the principal elements in continuous and firm contacting position. Still further, in achieving these aforesaid objectives, the quick attachment device of the present invention also is arranged to have the lifting implement disposed at its closest possible location relative to the extending ends of the lifting arm so that there is only a very minimal overbalance from the lifting implement acting on the lifting arms. That is, the quick attachment device of this invention is compact and presents its elements in a minimum distance from the point of attachment with the lift arms to the location of the nearest working portion of the implement itself.

Other objects and advantages will become apparent upon reading the following description in light of the accompanying drawings.

DETAILED DESCRIPTION OF THE PREFERRED EMBODIMENT

Figure 1:
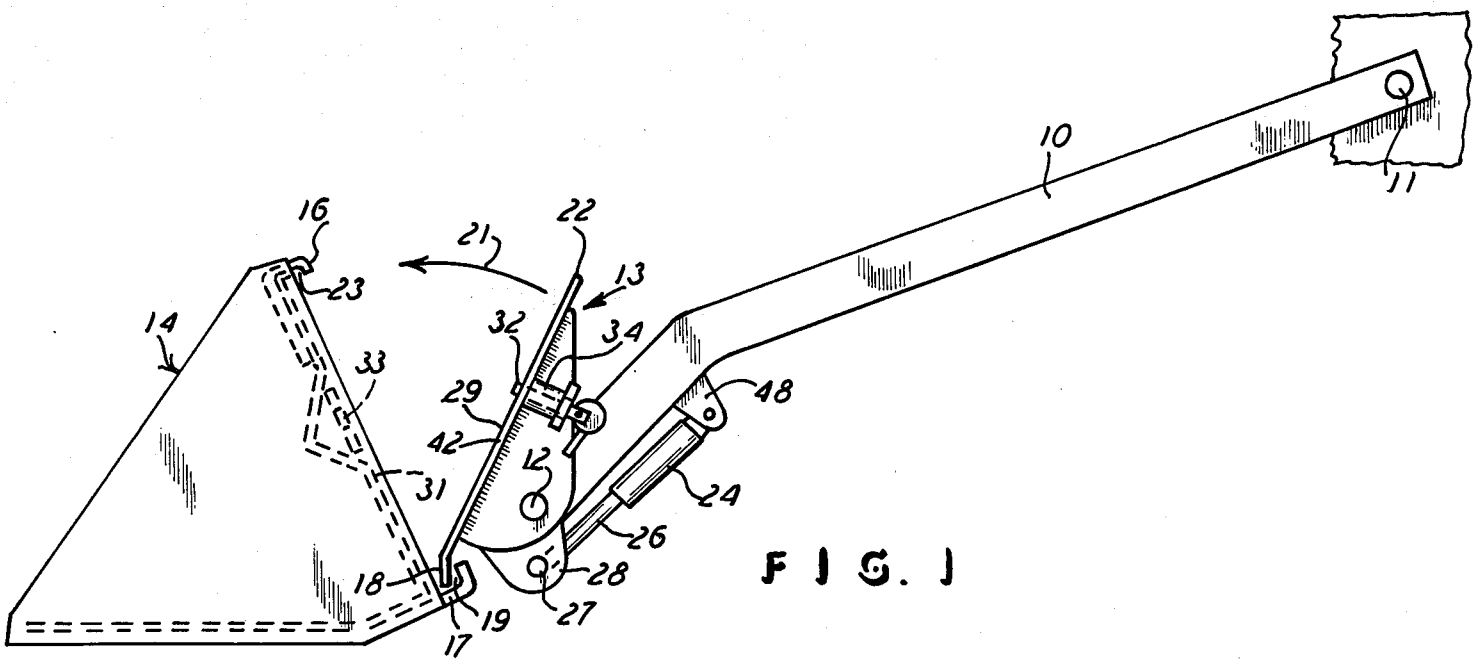
FIG. 1 is a side elevational view of the quick attachment device of this invention related to a lift bucket.

The drawings show conventional tractor lift mechanism which includes a lift arm 10 which would be pivotally attached to a tractor (unshown) at the location 11 and would extend from the tractor and present a pivot pin 12 which supports an attachment member 13 of this invention. That is, the general arrangement is of a conventional tractor having conventional lift arms which support the quick attachment devices, such as in the arrangements generally shown in the aforesaid cited patents.

The attachment member 13 can be attached to and released from a loader bucket 14 which has an upper attaching portion 16 and a lower attaching portion 17, both of which releasably attach to the attachment member 13 by having the attachment member lower end 18 disposed within the opening 19 in the attaching portion 17 and then by moving the attachment member 13 in the direction of the arrow designated 21 until the attachment member 13 is positioned to have its upper extension 22 movable upwardly and received within an opening 23 in the upper attaching portion 16.

The attachment member 13 is pivotally supported on the lift arms of the tractor, such as the arm 10, at the location of the pin 12, and the attachment member 13 thus pivots about the axis of the pin or pins 12, as will be understood by one skilled in the art. To achieve the pivot action, there is a fluid cylinder 24 having its rod 26 connected to a pin 27 which attaches to a plate 28 on the lower end of the attachment member 13. Thus, upon extension and contraction of the rod 26, the pin 27 will be moved about the axis of the pin 12 to pivot the attachment member 13 about the axis of the pin 12, such as in the direction of the arrow 21, as mentioned. Of course the operator would have control of the cylinder 24 by means of unshown controls located at the operator's seat, in a conventional arrangement of remote control of a fluid cylinder.

Figure 2:
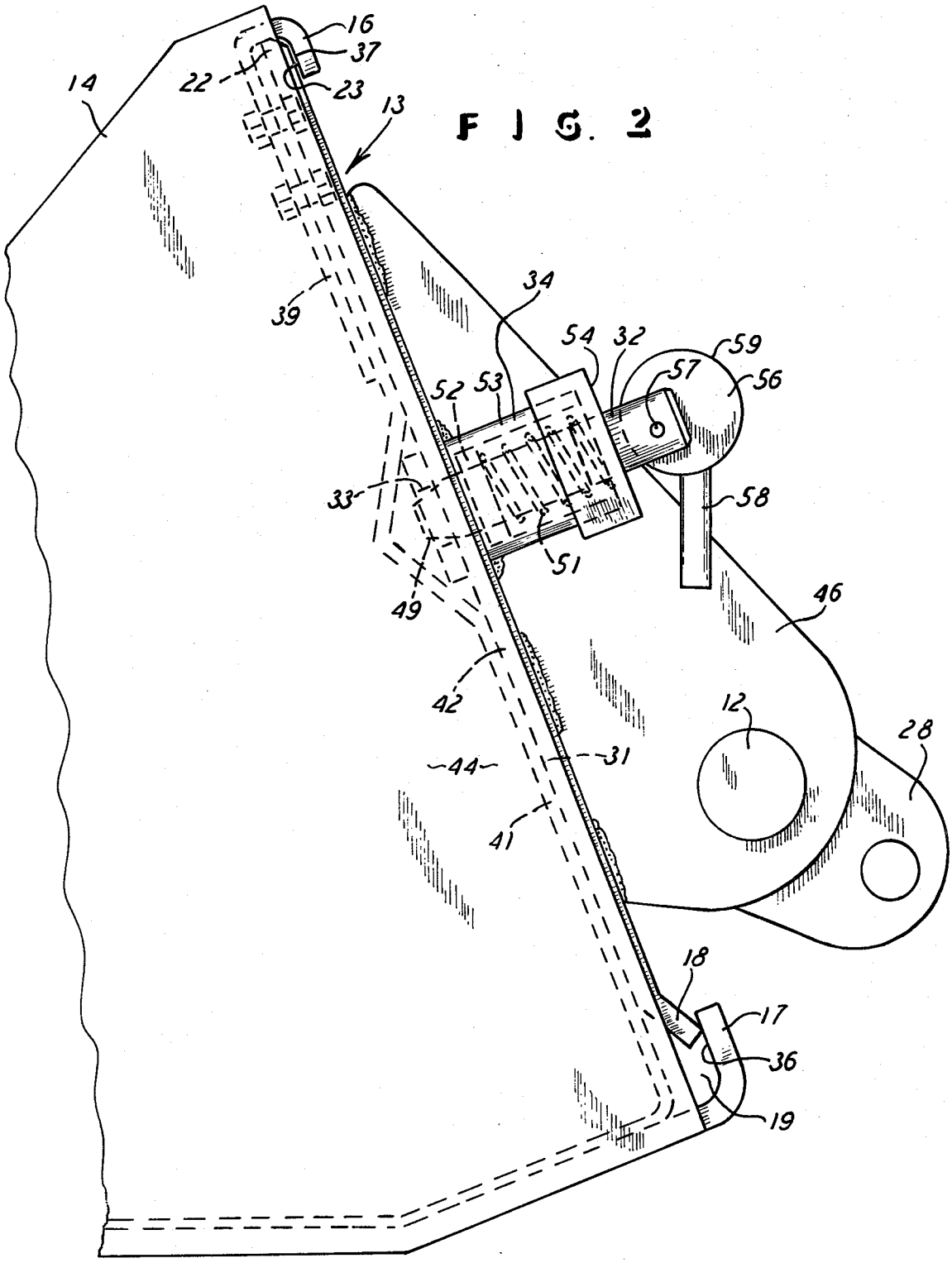
FIG. 2 is an enlarged side elevational view of the quick attachment device shown in FIG. 1.

Thus, the implement or attachment 14 has the two spaced-apart attaching portions 16 and 17 which present confined openings 19 and 23 faced toward each other. The attachment member 13 has two spaced-apart extension portions 18 and 22 in upper and lower relative positions thereon, and the maximum dimension of the spacing between the portions 18 and 22 is less than the maximum dimension of the spacing between the openings 19 and 23, all for having the attachment member 13 fit between the openings 19 and 23, as shown in FIG. 2. The portions 18 and 22 are shown to extend away from each other and terminate in free ends. Further, when the attachment member 13 is brought into attaching position relative to the member 14, that is when the planar surface 29 of the attachment member 13 is brought flush with the planar surface 31 of the member 14, the attachment member 13 can still move up and down within the confines of the openings 19 and 23, all to have a securing pin 32 engage an opening 33 shown in FIG. 2 and located on the member 14. Thus, the pin 32 is part of a spring-urged fastener designated 34 and is movably mounted on the member 13 to move transverse to the plane 29 and thus move into and out of the opening 33, as needed and desired to locate and secure the attachment member 13 relative to the implement 14.

By way of further description and explanation of the structure and the attaching process, it should be seen and understood that the attachment member lower extension portion 18 is positioned in the opening 19 and then the attachment member 13 is pivoted into abutting and securing position with the implement 14 and the attachment member extension portion 22 is then positioned within the opening 23 when the attachment member 13 is raised relative to the implement 14 and positioned as shown in FIG. 2. The pivot action of the attachment member 13 as mentioned causes the lower extension portion 18 to become snug with the hook shaped attaching portion 17 since the extension portion 18 is angled or offset relative to the plane or face 29. Thus, FIG. 2 shows the offset extension portion 18 is in contact with the implement rear surface 31 and the attaching portion surface 36, all to have the extension portion 18 snug within the opening 19 and firmly fixed with the hook-shaped attaching portion 17. Further, the attaching portion 16 is hook shaped and has its surface 37 spaced from the implement wall or plane 31 a distance only slightly greater than the thickness of the implement extension portion 22, and thus the portion 22 is snugly received in the opening 23 and there is virtually no movement between the attachment portion 16 and the extension portion 22. Therefore, both the upper and lower extension portions 22 and 18 of the attachment member 13 are snug with the implement 14, in the secured or attached position, and thus the quick attach device has no play or looseness but is snugly arranged as described.

Figure 3:
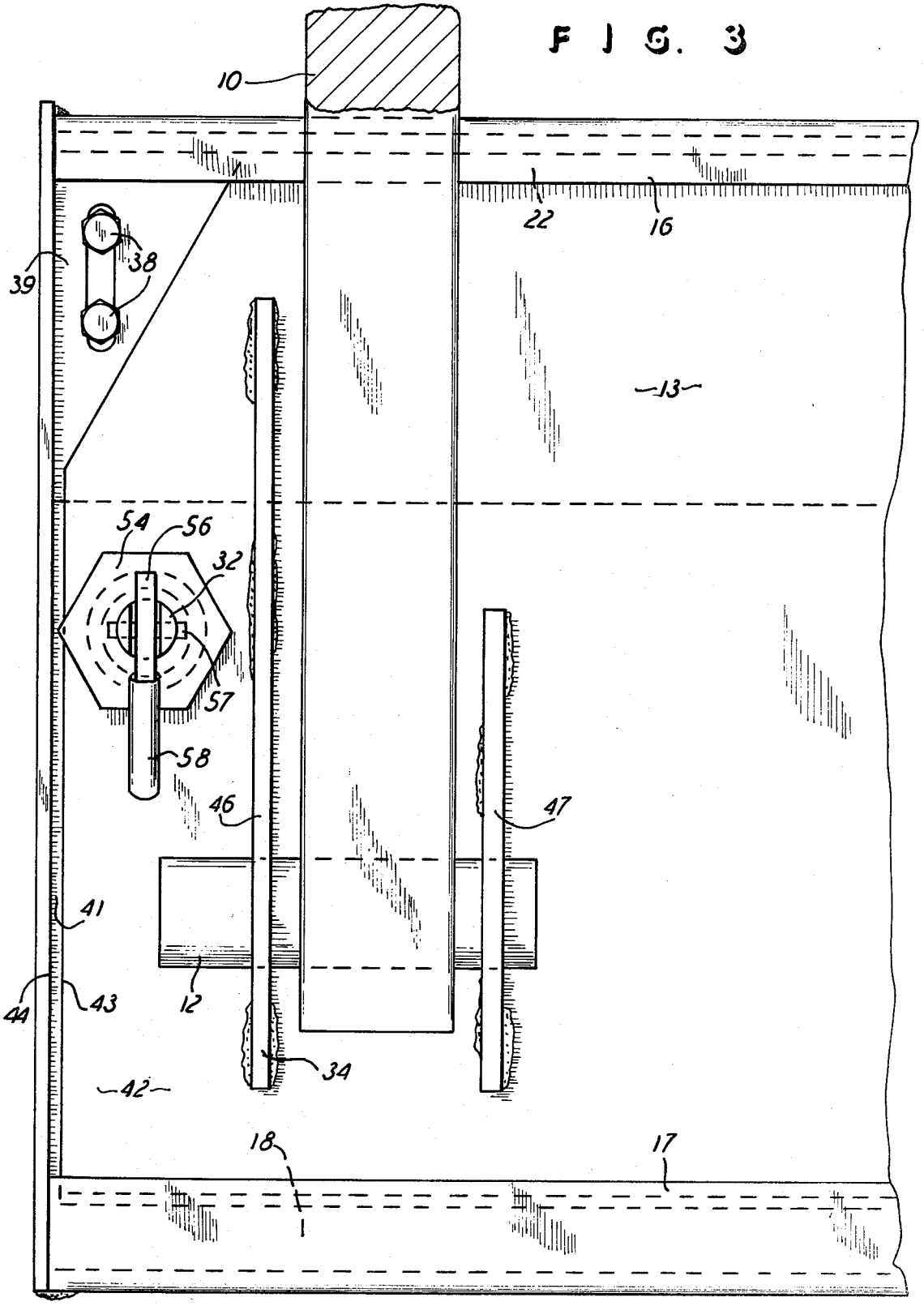
FIG. 3 is a rear elevational view of FIG. 2.

Further, FIG. 3 shows that the attaching portions 16 and 17 are hook shaped and extend for the width of the implement 14. FIGS. 2 and 3 further show the attachment portion 16 can be adjustably secured with the implement 14 to be raised and lowered thereon by means of two securing bolts 38 which engage a corner of a plate 39 forming an extension to the attachment portion 16 and extending around to the interior of the bucket-type implement 14 and thus be bolted to the rear wall designated 41 of the bucket implement 14. The adjustment by means of the adjusting bolts 38 permits the raising and lowering of the hook-shaped attachment member 16 to thus accommodate the overall height of the attachment member plate portion 42 which is of a planar shape and presented at the forwardly-located portion of the attachment member 13 relative to the implement 14. Therefore, the attachment member plate 42 extends across the attachment member 13, as shown in FIG. 3, and it fits and is sized relative to the implement 14 to have its lateral edges, such as the edge 43 disposed immediately adjacent the side plate or wall 44 of the implement 14. The wall 44 extends slightly beyond the implement rear wall 41, as seen in FIG. 2, and thus the attachment member plate 42 can be disposed between the extending wall edges 44 and is thus guided thereon and there are therefore the interrelated guide portions 43 and 44 relative to the attachment member 13 and the implement 14. As such, the operator can readily guide and position the attachment member 13 relative to the implement 14, all for assuring proper positioning and particularly assuring the engagement of the fastener mechanism 34, as mentioned. In making the attachment, the operator will not leave his seat, but he will simply position the plate 42 as shown in FIG. 1 and then actuate the cylinder 24 to cause the attachment member 13 to pivot into seated position with the implement 14, and then the operator can actuate the lift arms 10 to raise the attachment member 13 into the position shown in FIG. 2 at which time the spring-loaded fastener 34 will automatically engage and hold the attachment parts in the FIG. 2 position, all as desired.

FIGS. 2 and 3 further show spaced-apart plates 46 and 47 affixed to the planar plate 29 for supporting the pin 12 and connecting with the tractor arm 10, in the usual manner and as described and also as shown herein. In a similar arrangement which is conventional, there would be two spaced-apart plates or ears 28 for supporting the pin 27, and there is also a plate 48 affixed to the arm 10 for supporting the other end of the cylinder 24.

The spring-urged fastener mechanism 34 includes the pin 32 which has its end 49 snugly received within the opening 33. A compression spring 51 surrounds the pin 32 and bears against an enlargement 52 affixed with the pin 32 to thus urge the pin 32 toward and into the opening 33, and the pin of course has a tapered end for moving into the opening 33 in an automatic fashion. A spring housing 53 is attached to the plate 29 and has a hollow interior for sidably receiving the pin enlargement 52, and the housing has a rear wall 54 faced toward a cam 56 secured to the pin 32 by another pin 57. A lever or handle 58 is attached to the cam 56 for rotating the cam 56 to have its eccentric circumference 59 bear against the surface 54 and thus retract the pin 32 from the opening 33 and hold the pin 32 retracted.

With the spring-urged fastener mechanism described, the automatic attachment is achieved since the pin 32 will enter the opening 33 when the two are axially aligned, and it will be seen that the axis of alignment is transverse to the plane 29 of the plate 42, and thus the operator only needs to position the plate 42 within the guide portions 44 of the implement 14 and then raise the plate 42 to have it move into the opening 23 and also have the pin 32 move into the opening 33. In releasing the pin 32, the operator only needs to rotate the handle 58 to have the pin 32 withdraw from the opening 33, and then he will have the plate 42 lowered relative to the implement 14 and remove the plate 42 from the attaching portions 16 and 17, all by means of the lift arms 10 and the actuation of the cylinder 24.

In the function of attaching the attacher 13 to the implement 14, the spring-urged fastener mechanism is thus provided to have the self-fastening portions and features described and to have the common axis therebetween, namely, the axis extending longitudinally of the pin 32 and that is of course the axis for the hole 33, and that axis is arranged to be established when the attachment member 13 is moved relative to the attaching portions 16 and 17 of the implement 14. That is, with the spring-urged and thus self-acting fastener mechanism described, maneuvering the attachment member 13 will cause the automatic locking or engagement of the fastener mechanism. Therefore, in the assembled position in FIG. 2, the attachment portions 16 and 17 and the extension portions 18 and 22 are on a common plane, and the common axis of the fastener mechanism is transverse to that plane so that moving the attachment plate 42 along its planar face or plane 29 will cause the automatic engagement for the fastener mechanism 34.

What is claimed is:

1. A quick attachment device on a lifting tractor, comprising an implement for use in attaching to a tractor to lift material and having two spaced-apart attaching portions disposed in upper and lower relative positions and with said portions presenting confined openings faced toward each other, support arms on said tractor, a pivot pin on said support arms, an attachment member pivotly mounted on said pivot pin and extending thereabove and having two spaced-apart extension portions disposed in upper and lower relative positions and extending away from each other in free ends and with the maximum dimension of the spacing therebetween being less than the maximum dimension of the spacing between said openings of said attaching portions to have said attachment member nest into and extend between said openings of said attaching portions and be movable respectively toward and away from said attaching portions, said free ends being in snug contact in said attaching portions in the nested position, and a spring-urged fastener mechanism releasably interconnected between said implement and said attachment member and having self-fastening portions on a common axis and including a spring-urged pin and opening with their longitudinal axes disposed on said common axis and with said pin being movable into fastening position when said implement and said attachment member are nested together, and with said common axis being arranged to be automatically established when said attachment member is moved relative to said attaching portions in the aforesaid manner, for locking said attachment member to said implement.

2. The quick attachment device on a lifting tractor as claimed in claim 1, wherein said extension portions are fixedly spaced apart and said attaching portions being hook-shaped for releasably receiving said extension portions, and said spring-urged fastener mechanism having its said common axis directed at a right angle to the plane extending between the assembled said attaching portions and said extension portions.

3. The quick attachment device on a lifting tractor as claimed in claim 2, including a leverage type of release connected with said pin for releasing said pin.

4. The quick attachment device on a lifting tractor as claimed in claim 3, wherein said release includes a movable cam and a surface for moving said cam in the release of said pin.

5. The quick attachment device on a lifting tractor as claimed in claim 4, wherein said attachment member includes a planar plate in the extent between said extension portions, and said implement has a planar configuration in parallel planar abutment with said plate, and said pin being spring-mounted on said plate and axially extending transverse thereto.

6. The quick attachment device on a lifting tractor as claimed in claim 1, including an adjustable piece interengaged between said implement and said attachment member for altering the spacing between said portions of one of said implement and said attachment member to adjust the nesting therebetween.

7. The quick attachment device on a lifting tractor as claimed in claim 1, wherein said attachment member includes a pivotally-mounted plate which is planar in the extent between said extension portions, and one of said extension portions being offset away from said implement for initial insertion of said offset extension portion into its said opening and subsequent pivoting of said plate about its said offset extension portion to have said offset extension portion snug within the latter said opening.

8. The quick attachment device on a lifting tractor as claimed in claim 7, including a fluid cylinder assembly pivotally connected with said plate and said support arms for pivoting said plate.

9. The quick attachment device on a lifting tractor as claimed in claim 1, wherein said attachment member includes a pivotally-mounted plate which is planar in the extent between said extension portions, and one of said extension portions being offset away from said implement and the other of said extension portions being disposed on the plane of said plate.

10. The quick attachment device on a lifting tractor as claimed in claim 1, including said implement and said attachment member being interrelated by having guide-on portions thereon for aligning said attachment member with said implement and thereby have said spring-urged fastener aligned for interconnection between said implement and said attachment member.

11. The quick attachment device on a lifting tractor as claimed in claim 7, wherein said opening for said one extension portion is larger than the other of said openings and is of a size to loosely receive said one extension portion when the latter is first inserted into its said opening, and with said one extension portion being offset to extend oblique to the plane between said openings and snug in its said openings when both said extension portions are in their respective said openings.

* * * * *